US011735820B2

(12) United States Patent
Kim et al.

(10) Patent No.: US 11,735,820 B2
(45) Date of Patent: Aug. 22, 2023

(54) ANTENNA MODULE

(71) Applicant: AMOTECH CO., LTD., Incheon (KR)

(72) Inventors: Beom Jin Kim, Bucheon-si (KR); Jong Ho Park, Namwon-si (KR)

(73) Assignee: AMOTECH CO., LTD., Incheon (KR)

( * ) Notice: Subject to any disclaimer, the term of this patent is extended or adjusted under 35 U.S.C. 154(b) by 52 days.

(21) Appl. No.: 16/638,695

(22) PCT Filed: Jul. 13, 2018

(86) PCT No.: PCT/KR2018/007984
§ 371 (c)(1),
(2) Date: Feb. 12, 2020

(87) PCT Pub. No.: WO2019/035560
PCT Pub. Date: Feb. 21, 2019

(65) Prior Publication Data

US 2020/0220265 A1 Jul. 9, 2020

(30) Foreign Application Priority Data

Aug. 18, 2017 (KR) ..... 10-2017-0104794

(51) Int. Cl.
*H01Q 7/06* (2006.01)
*H01Q 1/12* (2006.01)

(52) U.S. Cl.
CPC ..... *H01Q 7/06* (2013.01); *H01Q 1/12* (2013.01)

(58) Field of Classification Search
CPC ..... H01Q 7/06; H01Q 1/12; H01Q 1/2283; H01Q 7/08
See application file for complete search history.

(56) References Cited

U.S. PATENT DOCUMENTS

2005/0270249 A1* 12/2005 Saegusa ..... H01Q 7/00 343/788
2007/0247387 A1* 10/2007 Kubo ..... H01Q 7/08 343/787

(Continued)

FOREIGN PATENT DOCUMENTS

GB 2433385 A * 6/2007 ..... H01Q 1/2241
JP 2002-16419 A 1/2002

(Continued)

*Primary Examiner* — Dieu Hien T Duong
(74) *Attorney, Agent, or Firm* — CL Intellectual LLC

(57) ABSTRACT

Disclosed are an antenna module and a method for producing same, the antenna module having an insulating substrate interposed between a base substrate and electrodes so as to keep the base substrate apart from the electrodes and thereby prevent interference by the electrodes in the magnetic permeability of the base substrate. The disclosed antenna module comprises: a base substrate made of a magnetic material; an insulating substrate stacked on the lower surface of the base substrate; a first electrode disposed on the lower surface of the insulating substrate; a second electrode disposed, apart from the first electrode, on the lower surface of the insulating substrate; and a radiation wire which is wound around the base substrate and/or the insulating substrate and has one end thereof connected to the first electrode and the other end thereof connected to the second electrode.

5 Claims, 9 Drawing Sheets

(56) References Cited

U.S. PATENT DOCUMENTS

| | | | | |
|---|---|---|---|---|
| 2015/0303572 | A1* | 10/2015 | Sergey | G06K 7/10336 343/866 |
| 2017/0040690 | A1* | 2/2017 | Peralta | H01F 27/2871 |
| 2017/0229777 | A1* | 8/2017 | Kim | H04B 5/0081 |
| 2017/0229778 | A1* | 8/2017 | Tenno | H01Q 1/48 |

FOREIGN PATENT DOCUMENTS

| | | | | |
|---|---|---|---|---|
| JP | 2007-60138 | A | | 3/2007 |
| JP | 2007306137 | A | * | 11/2007 |
| JP | 2008109484 | A | * | 5/2008 |
| JP | 2013222264 | A | * | 10/2013 |
| JP | 2017-50811 | A | | 3/2017 |
| JP | 2017-98647 | A | | 6/2017 |
| KR | 2016-0050502 | A | | 5/2016 |
| WO | 2009126614 | A1 | | 10/2009 |

* cited by examiner

| No | Thickness of electrode sheet | Inductance(uH) | Resistance(Ω) | Q value |
|---|---|---|---|---|
| | | @10.579MHz, Impedance Analyzer | | |
| 1 | 0um | 3.49 | 4.62 | 50.21 |
| 2 | 50um | 3.51 | 4.38 | 53.27 |
| 3 | 100um | 3.53 | 4.20 | 55.87 |
| 4 | 150um | 3.44 | 4.16 | 54.97 |
| 5 | 200um | 3.38 | 4.16 | 54.01 |
| 6 | 50um | 3.56 | 5.59 | 42.33 |

FIG.5

| No | Separation interval between first base substrate and electrode | Inductance(uH) | Resistance(Ω) | Q value |
|---|---|---|---|---|
| | | @10.579MHz, Impedance Analyzer | | |
| 1 | 0um | 3.56 | 5.94 | 39.84 |
| 2 | 10um | 3.56 | 5.75 | 41.15 |
| 3 | 20um | 3.56 | 5.67 | 41.73 |
| 4 | 30um | 3.56 | 5.55 | 42.64 |
| 5 | 40um | 3.56 | 5.43 | 43.58 |
| 6 | 50um | 3.56 | 5.59 | 42.33 |

FIG. 10

ANTENNA MODULE

CROSS-REFERENCE TO RELATED APPLICATIONS

This application is a National Stage of International patent application PCT/KR2018/007984, filed on Jul. 13, 2018, which claims priority to foreign Korean patent application No. KR 10-2017-0104794, filed on Aug. 18, 2017, the disclosures of which are incorporated by reference in their entirety.

FIELD OF THE INVENTION

The present disclosure relates to an antenna module for Near-field magnetic induction communication (NFMI) or near-field interaural communication, and more particularly, to an antenna module and a method of manufacturing the same, which are mounted to an ear module such as a wearable device, a hearing aid, or a wireless earphone to perform communication with the other device (for example, a wearable device, the main body of a hearing aid, or the other ear module).

BACKGROUND

An ear module is a device that plugs into his/her ears to allow him/her personally to listen to a sound source. The ear module may be classified into a wired ear module and a wireless ear module according to a connection method with a sound source device.

The wireless ear module receives the sound source from the other ear module or the sound source device through wireless communication to output the sound source. For example, in the case of being applied to a wireless earphone, the wireless ear module may receive the sound source from the sound source device through Bluetooth, or may receive and output the sound source from the other wireless ear module. Here, the wireless ear module may be composed of a main ear module for receiving and outputting the sound source from the sound source device or a sub-ear module for receiving and outputting the sound source from the main ear module.

The wireless ear module is mounted with an antenna for transmitting and receiving the sound source with the sound source device or the other wireless ear module. Since the wireless ear module is compactly formed, a space capable of mounting the antenna is very narrow, and since it is disposed to be spaced the left and the right with respect to a wearer's head, it should be compact and be able to communicate through the body (that is, the head).

The wireless ear module has been mounted with a Bluetooth antenna for performing Bluetooth type wireless communication, but there is a problem in that if a portion of the user's body is disposed between the wireless ear module and the sound source device in the Bluetooth antenna, the quality of the sound source is lowered or the playback of the sound source is interrupted, or the like.

Therefore, a recent wireless ear module is mounted with a NFMI antenna for performing wireless communication in a Near-field magnetic induction communication (NFMI) or near-field interaural communication method.

The NFMI antenna mounted to the wireless ear module is composed of a directional solenoid antenna having a wire wound around a ferrite sintered body. At this time, both ends of the wire are extended without a separate finishing treatment to form a lead wire, and the lead wire is connected to a circuit substrate of the wireless ear module through soldering.

However, there are problems in that since the wireless ear module has a very narrow mounting space (working space), workability is lowered when the NFMI antenna is mounted, a yield is lowered due to poor workability, antenna performance is lowered, and the like.

In order to solve these problems, a technology of mounting a Surface Mount Device (SMD) type NFMI antenna (hereinafter, referred to as a SMD antenna) to the wireless ear module has been studied.

Referring to FIG. 1, a conventional SMD antenna 10 is manufactured by winding a coil 12 around a ferrite sintered body 11 having an electrode formed on one surface thereof, and connecting both ends of the coil 12 to an electrode 13. At this time, the electrode 13 is formed by etching after directly printing a metal paste on the surface of the ferrite sintered body 11.

However, there is a problem in that since the conventional SMD antenna 10 directly prints the metal paste on the ferrite sintered body 11, the interference by the metal paste occurs in the magnetic permeability of the ferrite sintered body 11, thereby lowering a Quality Factor (Q), which is a value that is much affected by the magnetic permeability of the ferrite sintered body 11.

Further, there is a problem in that since the conventional SMD antenna 10 is a structure in which the electrode 13 (that is, the metal paste) directly contacts the ferrite sintered body 11, the interference occurs in the magnetic permeability of the ferrite sintered body 11, thereby lowering the Quality Factor (Q) to lower antenna performance.

SUMMARY OF THE INVENTION

The present disclosure is intended to solve the above conventional problems, and an object of the present disclosure is to provide an antenna module and a method of manufacturing the same, which interpose an insulating substrate between a base substrate and an electrode to separate the base substrate and the electrode, thereby preventing the interference by the electrode in the magnetic permeability of the base substrate.

An antenna module according to an embodiment of the present disclosure for achieving the object includes a base substrate of a magnetic material, an insulating substrate stacked on the lower surface of the base substrate, a first electrode disposed on the lower surface of the insulating substrate, a second electrode disposed to be spaced apart from the first electrode on the lower surface of the insulating substrate, and a radiation wire wound around the base substrate, having one end portion connected to the first electrode, and having the other end portion connected to the second electrode.

The base substrate may be a ferrite substrate, and the insulating substrate may be made of one selected from Polyimide (PI) and FR4. At this time, the thickness of the insulating substrate may be formed to 50 μm or more and 200 μm or less.

The first electrode may be disposed to be biased to the first short side of the insulating substrate, the second electrode may be disposed to be biased to the second short side of the insulating substrate, and the first electrode and the second electrode may be a metal material.

The radiation wire may be wound around a laminate on which the base substrate and the insulating substrate have been stacked to be wound around the upper surface of the base substrate and the lower surface of the insulating substrate. At this time, the radiation wire may be wound in a separation space between the first electrode and the second electrode in the lower surface of the insulating substrate.

The insulating substrate may include a first insulating substrate having the first electrode formed on the lower surface thereof and a second insulating substrate having the second electrode formed on the lower surface thereof, and disposed to be spaced apart from the first insulating substrate. At this time, the first insulating substrate may be disposed to be biased to the first short side of the base substrate, and the second insulating substrate may be disposed to be biased to the second short side of the base substrate. In this case, the radiation wire may be wound around the base substrate, and may be wound in a separation space between the first insulating substrate and the second insulating substrate in the lower surface of the base substrate.

According to the present disclosure, the antenna module and the method of manufacturing the same may interpose the insulating substrate between the base substrate and the electrode to separate the base substrate and the electrode, thereby preventing the interference by the electrode in the magnetic permeability of the base substrate.

Further, the antenna module and the method of manufacturing the same may interpose the insulating substrate between the base substrate and the electrode to separate the base substrate and the electrode, thereby preventing the interference by the electrode in the magnetic permeability of the base substrate to prevent the Quality Factor (Q) of the antenna from being lowered.

Further, the antenna module and the method of manufacturing the same may adjust the thickness of the insulating substrate interposed between the base substrate and the electrode to adjust the separation interval between the base substrate and the electrodes, thereby enhancing the Quality Factor (Q) of the antenna to maximize the antenna performance.

BRIEF DESCRIPTION OF THE DRAWINGS

FIGS. 3 to 5 are diagrams for explaining an antenna module according to a first embodiment of the present disclosure.

FIGS. 8 to 10 are diagrams for explaining an antenna module according to a second embodiment of the present disclosure.

DETAILED DESCRIPTION

Figure 1:
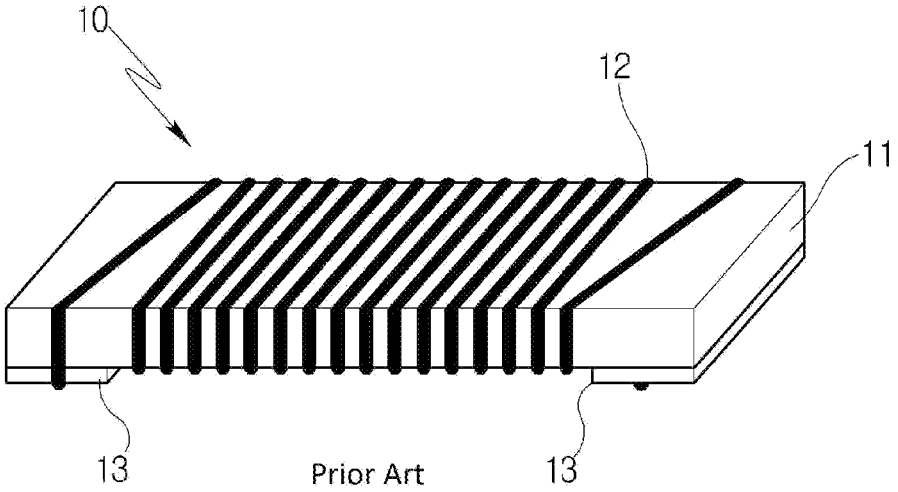
FIG. 1 is a diagram for explaining a conventional SMD antenna.

Hereinafter, the most preferred embodiments of the present disclosure will be described with reference to the accompanying drawings in order to specifically describe so that those skilled in the art to which the present disclosure pertains may easily implement the technical spirit of the present disclosure. First, in adding reference numerals to the components of each drawing, it should be noted that the same components have the same reference numerals as much as possible even if they are displayed in different drawings. Further, in describing the present disclosure, when it is determined that the detailed description of the related well-known configuration or function may obscure the gist of the present disclosure, the detailed description thereof will be omitted.

Figure 2:
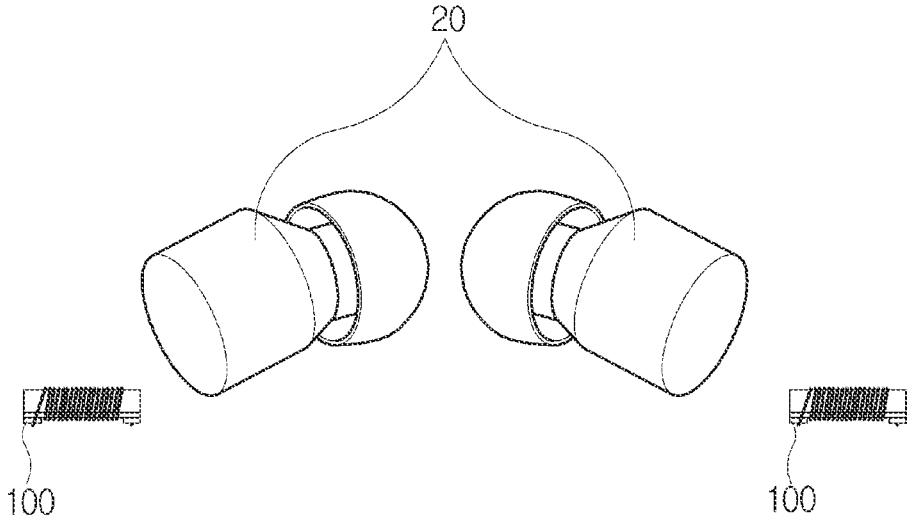
FIG. 2 is a diagram for explaining an antenna module according to an embodiment of the present disclosure.

Referring to FIG. 2, an antenna module 100 according to an embodiment of the present disclosure is mounted to a wireless ear module 20. At this time, the antenna module 100 is mounted in the wireless ear module 20 to perform wireless communication with one selected from the other wireless ear module 20 and a sound source device. Here, although it has been described in an embodiment of the present disclosure as an example that the antenna module 100 is mounted to the wireless ear module 20 constituting a wireless earphone in order to easily describe the antenna module 100, it is not limited thereto and may also be mounted to the wireless ear module 20 used in various devices such as a wearable device and a hearing aid.

Figure 3:
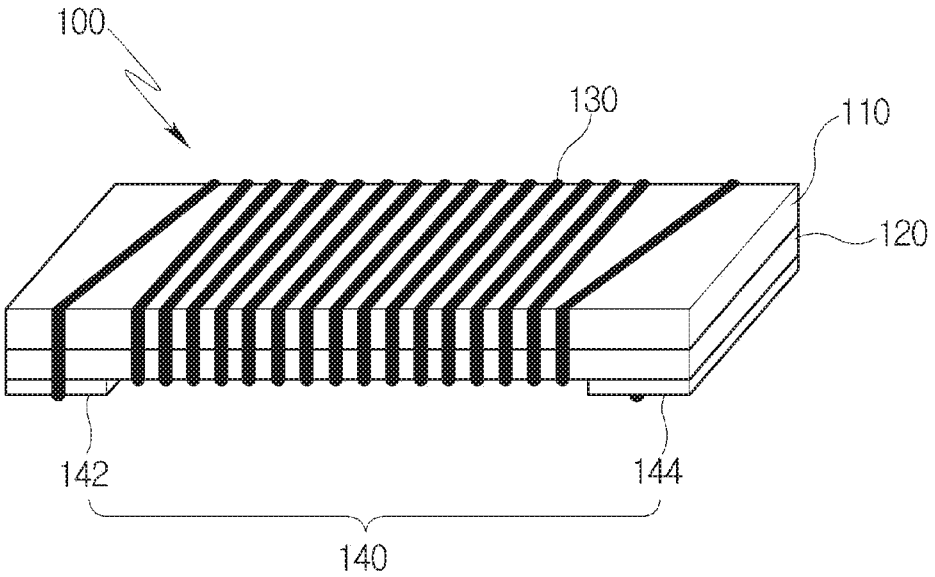
Figure 4:
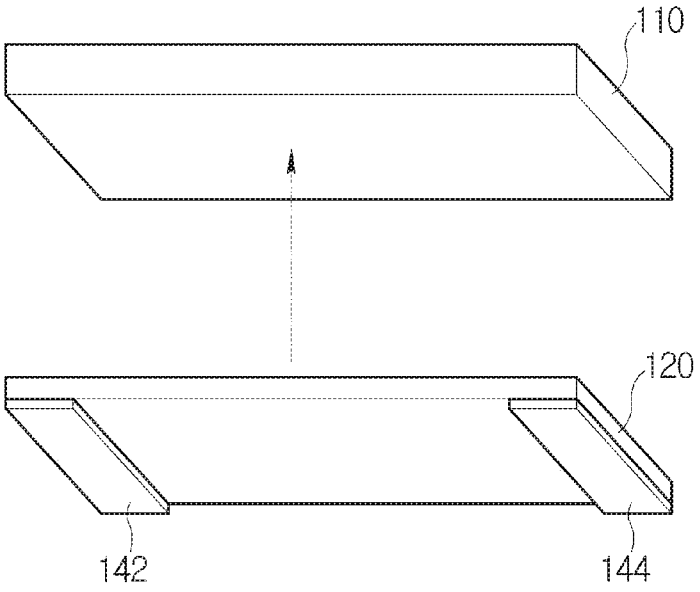
Figure 6:
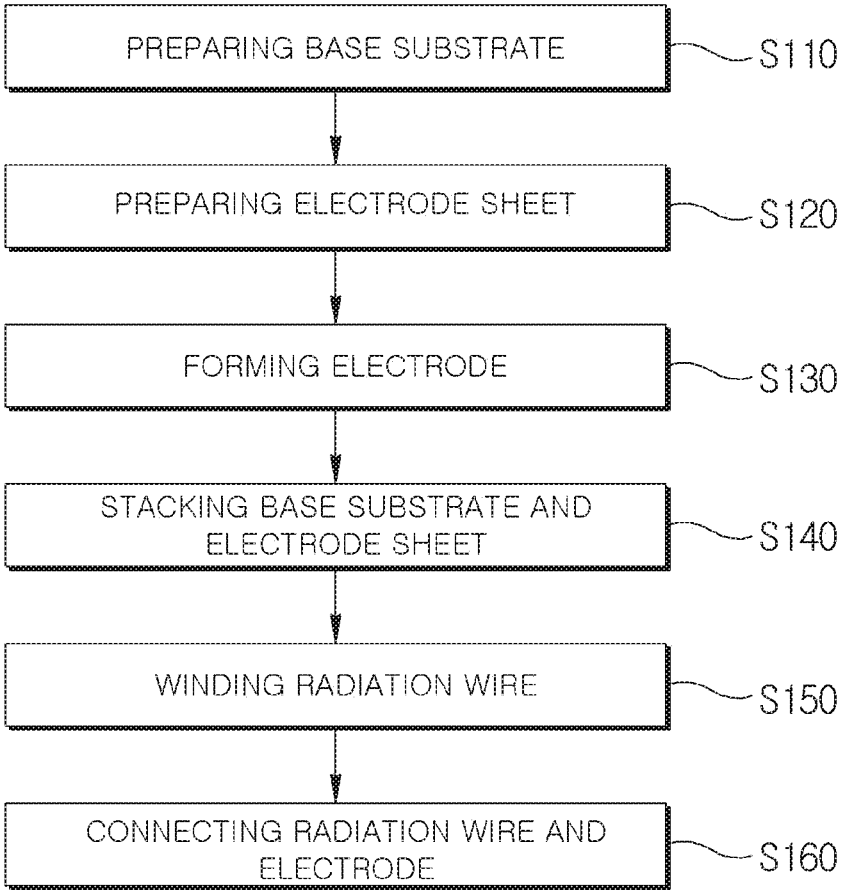
FIGS. 6 and 7 are diagrams for explaining a method of manufacturing the antenna module according to the first embodiment of the present disclosure.
Figure 7:
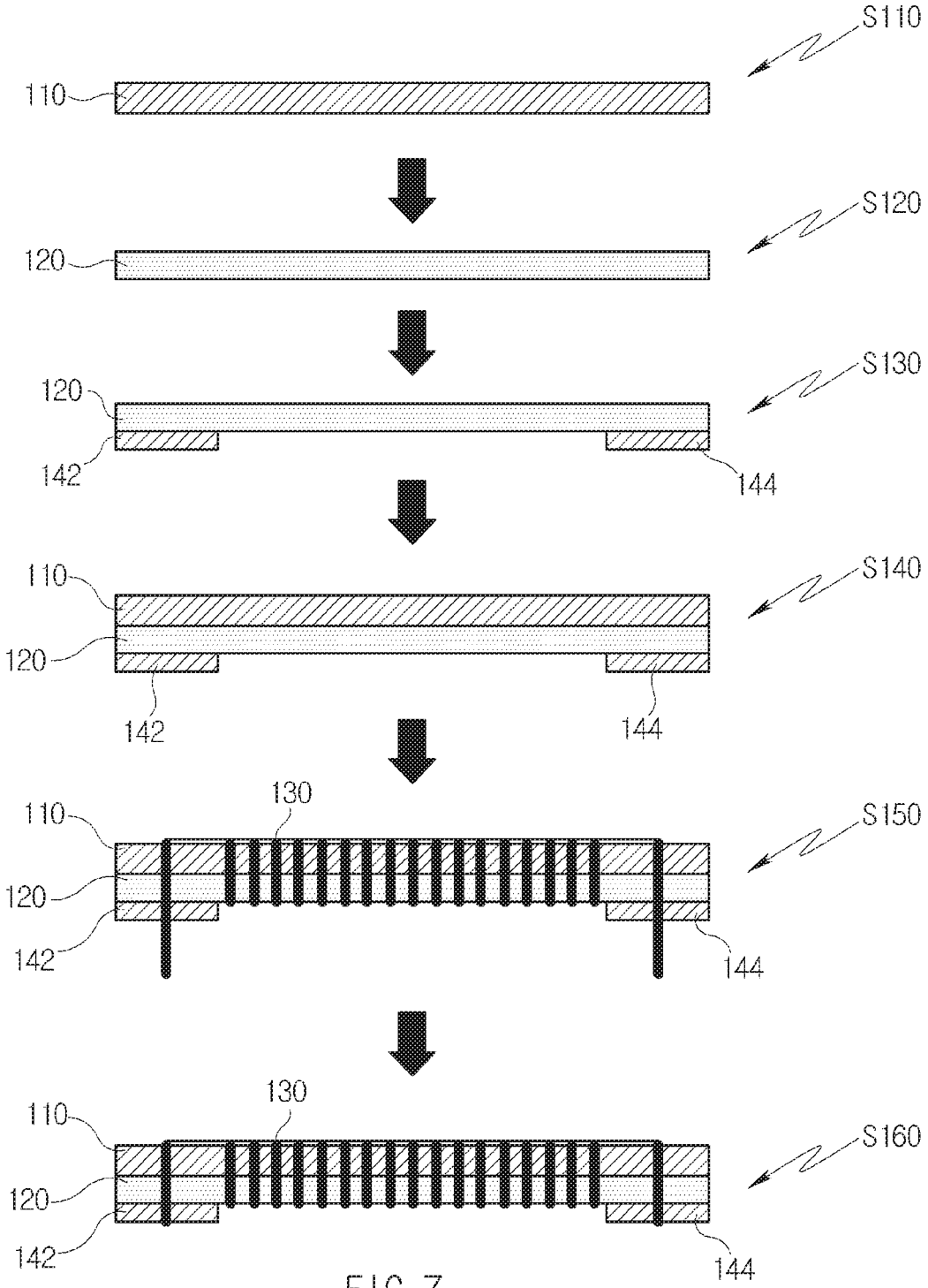

Referring to FIGS. 3 and 4, the antenna module 100 according to a first embodiment of the present disclosure is configured to include a base substrate 110, an insulating substrate 120 disposed under the base substrate 110, and a radiation wire 130 wound around the base substrate 110 and the insulating substrate 120.

The base substrate 110 is formed of a magnetic body substrate having magnetic permeability. At this time, the magnetic body substrate is, for example, a ferrite substrate of a rectangular parallelepiped shape having a predetermined thickness.

The base substrate 110 is formed of a rigid magnetic body substrate because the radiation wire 130 is wound thereon. At this time, the base substrate 110 may also be a flexible magnetic body substrate if the insulating substrate 120 is rigid.

The insulating substrate 120 is formed of an insulating substrate having a predetermined thickness. At this time, the insulating substrate 120 is formed of a flexible insulating substrate. Here, the insulating substrate 120 is, for example, an insulating substrate made of one material selected from Polyimide (PI) and FR4. Here, an adhesive agent may be applied between the base substrate 110 and the insulating substrate 120.

The insulating substrate 120 is disposed under the base substrate 110. At this time, the upper surface of the insulating substrate 120 contacts the lower surface of the base substrate 110.

The insulating base 120 has a first electrode 142 and a second electrode 144 formed on the lower surface thereof. At this time, the first electrode 142 and the second electrode 144 are formed on the lower surface of the insulating substrate 120 through a paste printing process. That is, the first electrode 142 and the second electrode 144 are formed by etching after printing a conductive paste on the lower surface of the insulating substrate 120. Here, the conductive paste is, for example, a metal paste having conductivity such as copper (Cu) or silver (Ag).

The first electrode 142 and the second electrode 144 are formed to be spaced apart from each other on the lower surface of the insulating substrate 120. That is, the first electrode 142 is formed to be biased in the first short side direction of the insulating substrate 120. The second electrode 144 is formed to be biased in the second short side direction of the insulating substrate 120.

The radiation wire 130 is wound around a laminate in which the base substrate 110 and the insulating substrate 120 have been stacked. At this time, the radiation wire 130 is sequentially wound around the upper surface of the base substrate 110 and the lower surface of the insulating substrate 120. Here, the radiation wire 130 wound around the lower surface of the insulating substrate 120 is wound only in the area where the first electrode 142 and the second electrode 144 are not formed.

The radiation wire 130 is spaced apart from each other between the windings (wires) wound around the same surface of the laminate. That is, as the interval between the wires in the radiation wire 130 is narrow, the resistance value for the use frequency increases to reduce the Quality Factor (Q). Therefore, the radiation wire 130 is wound so that the wires wound around the same surface are spaced apart from each other for the characteristics of the Quality Factor (Q).

The radiation wire 130 is connected to the first electrode 142 and the second electrode 144, respectively. That is, one end portion of the radiation wire 130 is connected to the first electrode 142 through soldering. The other end portion of the radiation wire 130 is connected to the second electrode 144 through soldering.

The first electrode 142 and the second electrode 144 are disposed to be spaced at a predetermined interval apart from the base substrate 110 by the insulating substrate 120. At this time, the separation interval between the first electrode 142 and the second electrode 144 and the base substrate 110 is determined by the thickness of the insulating substrate 120.

FIG. 5 illustrates data having measured the inductance, resistance, and Quality Factor (Q) of the antenna module 100 according to a change in the thickness of the insulating substrate 120 interposed between the base substrate 110 and the electrodes 140 (that is, the first electrode 142 and the second electrode 144).

The antenna module 100 has the Quality Factor Q of about 50.21 if the electrode 140 is formed directly on the base substrate 110 and the thickness of the insulating substrate 120 is '0'.

As the thickness of the insulating substrate 120 interposed between the base substrate 110 and the electrode 140 is sequentially increased from 50 μm to 200 μm, the Quality Factor (Q) of the antenna module 100 increases from about 53.27 to about 54.01, and then the Quality Factor (Q) of the antenna module 100 reduces to about 42.33 if the thickness of the insulating substrate 120 is increased to 250 μm.

Therefore, the antenna module 100 may interpose the insulating substrate 120 having the thickness of about 50 μm to about 200 μm between the base substrate 110 and the electrode 140, thereby enhancing the characteristics of the Quality Factor (Q).

Figure 8:
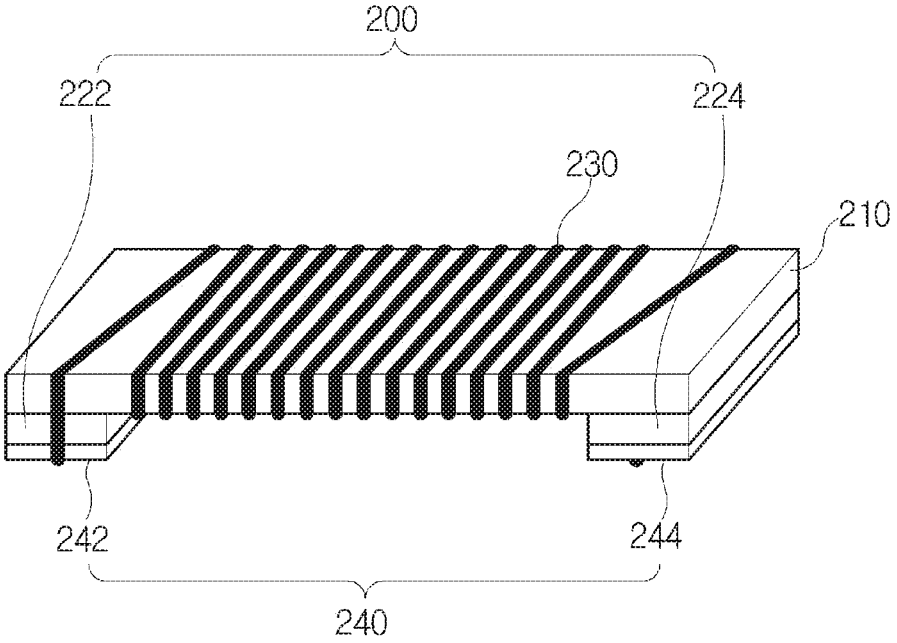
Figure 9:
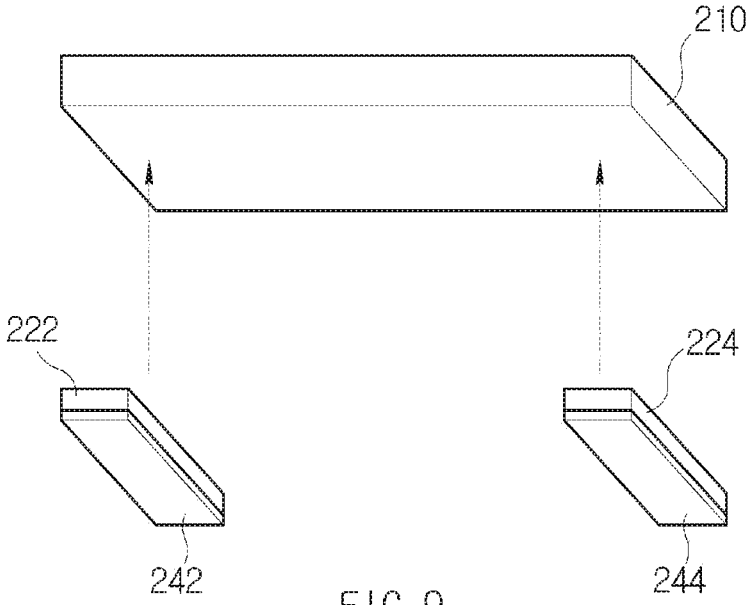

Referring to FIGS. 8 and 9, an antenna module 200 according to a second embodiment of the present disclosure is configured to include a base substrate 210, an insulating substrate 220 disposed under the base substrate 210, and a radiation wire 230 wound around the base substrate 210.

The base substrate 210 is formed of a magnetic body substrate having magnetic permeability. At this time, the magnetic body substrate is, for example, a ferrite substrate of a rectangular parallelepiped shape having a predetermined thickness.

The base substrate 210 is formed of a rigid magnetic body substrate because the radiation wire 230 is wound thereon. At this time, the base substrate 210 may also be a flexible magnetic body substrate if the first insulating substrate 222 is rigid.

The insulating substrate 220 is configured to include a first insulating substrate 222 and a second insulating substrate 224 formed separately.

The first insulating substrate 222 is formed of an insulating substrate having a predetermined thickness. At this time, the first insulating substrate 222 is formed of a flexible insulating substrate. Here, the first insulating substrate 222 is, for example, an insulating substrate made of one material selected from Polyimide (PI) and FR4.

The first insulating substrate 222 has the first electrode 242 formed on the lower surface thereof. At this time, the first electrode 242 is formed on the lower surface of the first insulating substrate 222 through a paste printing process. That is, the first electrode 242 is formed by printing a conductive paste on the lower surface of the first insulating substrate 222. At this time, the conductive paste is, for example, a metal paste having conductivity such as copper (Cu) or silver (Ag). Here, an adhesive agent may also be applied between the base substrate 210 and the first insulating substrate 222.

The first insulating substrate 222 is disposed under the base substrate 210. The upper surface of the first insulating substrate 222 contacts the lower surface of the base substrate 210. At this time, the first insulating substrate 222 is formed to be biased in the first short side direction of the base substrate 210. Therefore, the first electrode 242 is also formed to be biased in the first short side direction of the base substrate 210.

The second insulating substrate 224 is formed of an insulating substrate having a predetermined thickness. At this time, the second insulating substrate 224 is formed of a flexible insulating substrate. At this time, the second insulating substrate 224 is, for example, an insulating substrate made of one material selected from Polyimide (PI) and FR4. Here, an adhesive agent may also be applied between the base substrate 210 and the second insulating substrate 224.

The second insulating substrate 224 has the second electrode 244 formed on the lower surface thereof. At this time, the second electrode 244 is formed on the lower surface of the second insulating substrate 224 through a paste printing process. That is, the second electrode 244 is formed by printing a conductive paste on the lower surface of the second insulating substrate 224. Here, the conductive paste is, for example, a metal paste having conductivity such as copper (Cu) or silver (Ag).

The second insulating substrate 224 is disposed under the base substrate 210. The upper surface of the second insulating substrate 224 contacts the lower surface of the base substrate 210. At this time, the second insulating substrate 224 is formed to be biased in the second short side direction of the base substrate 210. Therefore, the second electrode 244 is also formed to be biased in the second short side direction of the base substrate 210.

The second insulating substrate 224 may also be disposed on the side portion or the upper portion of the base substrate 210. That is, the second insulating substrate 224 may be disposed on one selected from the remaining five surfaces except for one surface on which the first insulating substrate 222 has been disposed among the six surfaces of the base substrate 210.

As described above, as the first insulating substrate 222 and the second insulating substrate 224 are formed at both end sides of the base substrate 210, respectively, the first electrode 242 and the second electrode 244 are disposed to be spaced apart from each other under the base substrate 210.

The radiation wire 230 is wound around the base substrate 210. At this time, the radiation wire 230 is sequentially wound around the upper surface and the lower surface of the base substrate 210. Here, the radiation wire 230 wound around the lower surface of the base substrate 210 is wound only in the area where the first insulating substrate 222 and the second insulating substrate 224 are not formed.

The radiation wire 230 is spaced apart from each other between the windings (wires) wound around the same surface of the base substrate 210. That is, as the interval between the wires in the radiation wire 230 is narrow, the resistance value for the use frequency increases to reduce the Quality Factor (Q). Therefore, the radiation wire 230 is wound so that the wires wound around the same surface are spaced apart from each other for the characteristics of the Quality Factor (Q).

The radiation wire 230 is connected to the first electrode 242 and the second electrode 244, respectively. That is, one end portion of the radiation wire 230 is connected to the first electrode 242 through soldering. The other end portion of the radiation wire 230 is connected to the second electrode 244 through soldering.

FIG. 10 illustrates data having measured the inductance, resistance, and Quality Factor (Q) of the antenna module 200 according to a change in the separation interval between the base substrate 210 and the electrodes 240 (that is, the first electrode 242 and the second electrode 244).

The antenna module 200 has the Quality Factor Q of about 39.84 if the electrode 240 is formed directly on the base substrate 210 and the separation interval is '0'.

As the separation interval between the base substrate 210 and the electrodes 240 is sequentially increased from 10 μm to 40 μm, the Quality Factor (Q) of the antenna module 200 increases from about 41.15 to about 43.58, and then the Quality Factor (Q) of the antenna module 200 reduces to about 42.33 if the separation interval between the base substrate 210 and the electrodes 240 is increased to 50 μm.

Therefore, the antenna module 200 may enhance the characteristics of the Quality Factor (Q) when the separation interval between the base substrate 210 and the electrodes 240 is kept to about 10 μm to about 40 μm.

Figure 11:
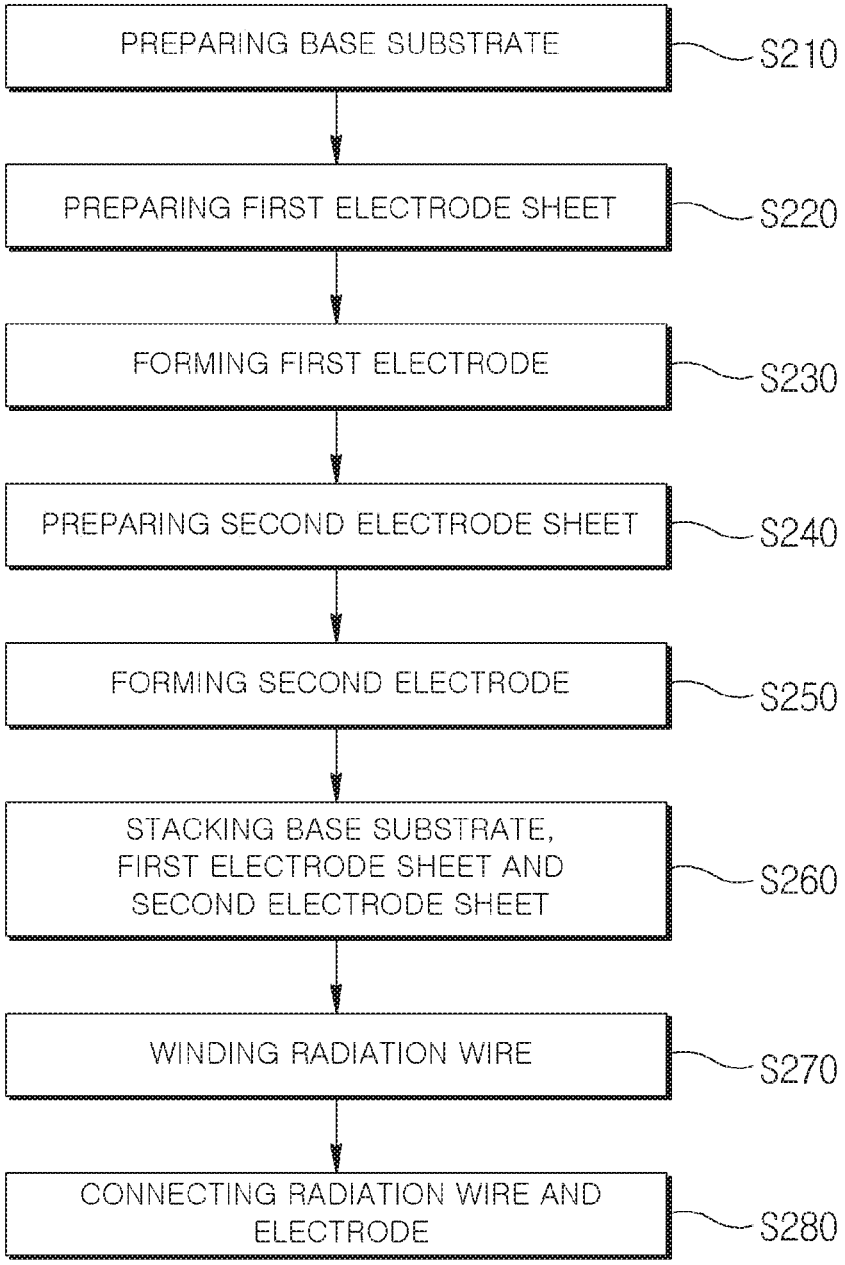
FIGS. 11 and 12 are diagrams for explaining a method of manufacturing the antenna module according to the second embodiment of the present disclosure.
Figure 12:
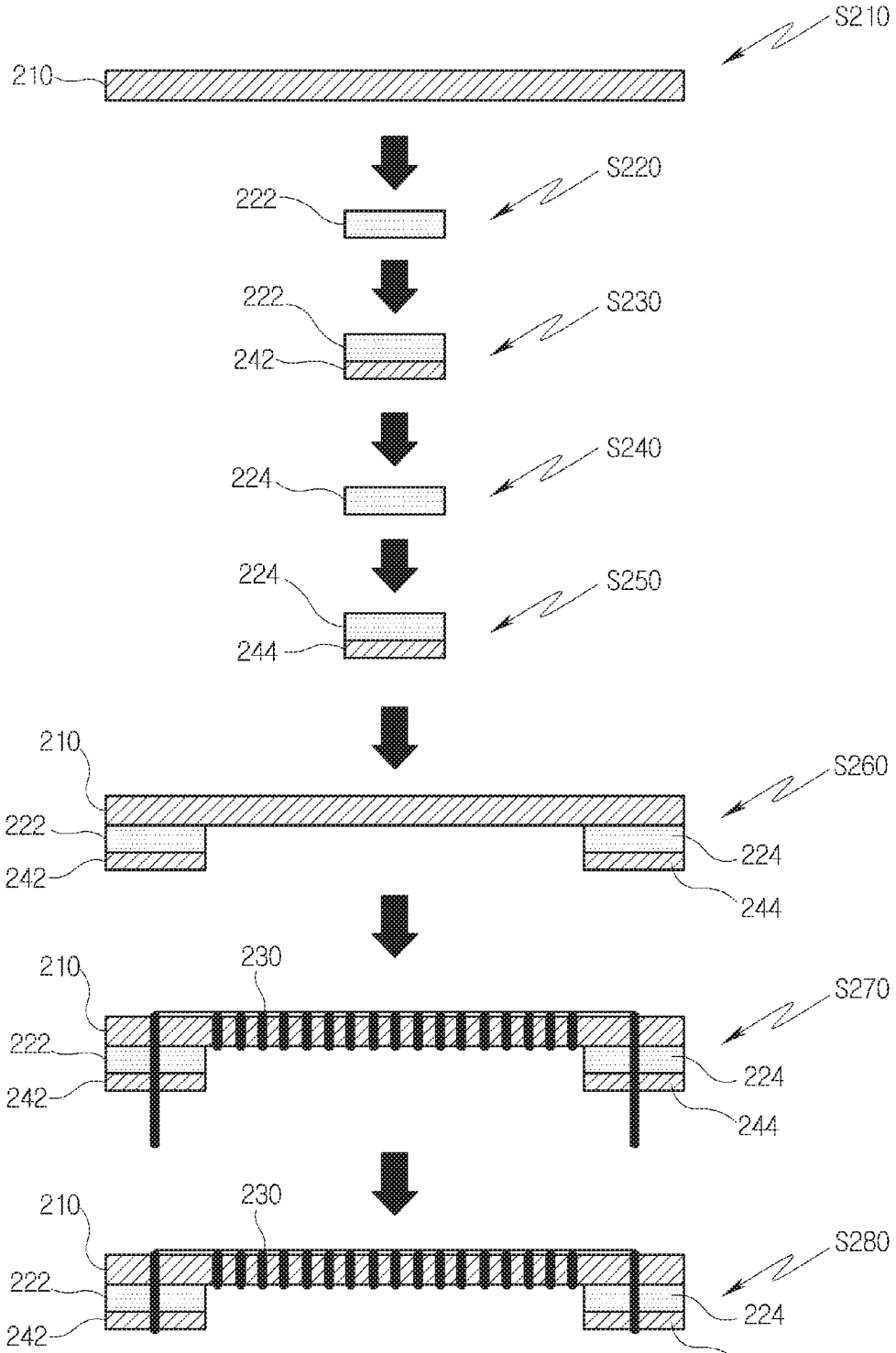

Referring to FIGS. 11 and 12, a method of manufacturing the antenna module 200 according to the second embodiment of the present disclosure includes preparing a base substrate (S210), preparing a first insulating substrate (S220), forming a first electrode (S230), preparing a second insulating substrate (S240), forming a second electrode (S250), stacking the base substrate (S260), winding a radiation wire (S270), and connecting the radiation wire and the electrode (S280).

The preparing of the base substrate (S210) prepares a magnetic body substrate having magnetic permeability as the base substrate 210. At this time, the base substrate 210 is a rigid magnetic body substrate because the radiation wire 230 is wound thereon in (S150), and is, for example, a ferrite substrate of a rectangular parallelepiped shape having a predetermined thickness. Here, the preparing of the base substrate (S210) may also prepare a flexible magnetic body substrate as the base substrate 210 if the rigid first insulating substrate 222 is prepared in (S120).

The preparing of the first insulating substrate (S220) prepares an insulating substrate having a predetermined thickness as the first insulating substrate 222. At this time, the preparing of the first insulating substrate (S220) prepares a flexible insulating substrate as the first insulating substrate 222. Here, the preparing of the first insulating substrate (S220), for example, prepares a flexible insulating substrate made of one material selected from Polyimide (PI) and FR4 as the first insulating substrate 222.

The forming of the first electrode (S230) forms the first electrode 242 on the first insulating substrate 222. The forming of the first electrode (S230) forms the first electrode 242 on the lower surface of the first insulating substrate 222. At this time, the forming of the first electrode (S230) forms the first electrode 242 on the lower surface of the first insulating substrate 222 through a paste printing process. Here, the conductive paste is, for example, a metal paste having conductivity such as copper (Cu) or silver (Ag).

The preparing of the second insulating substrate (S240) prepares an insulating substrate having a predetermined thickness as the first insulating substrate 222. At this time, the preparing of the second insulating substrate (S240) prepares a flexible insulating substrate as the first insulating substrate 222. Here, the preparing of the second insulating substrate (S240), for example, prepares a flexible insulating substrate made of one material selected from Polyimide (PI) and FR4 as the first insulating substrate 222.

The forming of the second electrode (S250) forms the second electrode 244 on the second insulating substrate 224. The forming of the second electrode (S250) forms the second electrode 244 on the lower surface of the second insulating substrate 224. At this time, the forming of the second electrode (S250) forms the second electrode 244 on the lower surface of the second insulating substrate 224 through a paste printing process. Here, the conductive paste is, for example, a metal paste having conductivity such as copper (Cu) or silver (Ag).

The stacking of the base substrate (S260) stacks the first insulating substrate 222 and the second insulating substrate 224 under the base substrate 210. At this time, the stacking of the base substrate (S260) stacks the first insulating substrate 222 and the second insulating substrate 224 to be spaced at a predetermined interval apart from each other.

To this end, the stacking of the base substrate (S260) stacks the first insulating substrate 222 to be disposed to be biased in the first short side direction of the base substrate 210, and stacks the second insulating substrate 224 to be disposed to be biased in the second short side direction of the base substrate 210.

The winding of the radiation wire (S270) winds the radiation wire 230 around the base substrate 210. At this time, the winding of the radiation wire (S270) winds the radiation wire 230 sequentially around the upper surface and the lower surface of the base substrate 210. Here, the radiation wire 230 wound around the lower surface of the base substrate 210 is wound only in a separation space formed by separating the first insulating substrate 222 and the second insulating substrate 224.

The connecting of the radiation wire and the electrode (S280) connects both ends of the radiation wire 230 wound around a laminate to the first electrode 242 and the second electrode 244, respectively. That is, the connecting of the radiation wire and the electrode (S280) connects one end portion of the radiation wire 230 to the first electrode 242 by soldering after contacting one end portion of the radiation wire 230 to the first electrode 242. The connecting of the radiation wire and the electrode (S280) connects the other end portion of the radiation wire 230 to the second electrode 244 by soldering after contacting the other end portion of the radiation wire 230 to the second electrode 244.

Although the preferred embodiment according to the present disclosure has been described above, it is understood that changes may be made in various forms, and those skilled in the art may practice various changed examples and modified examples without departing from the claims of the present disclosure.

The invention claimed is:

1. An antenna module, comprising:

a base substrate of a magnetic material;

an insulating substrate stacked on the lower surface of the base substrate;

a first electrode disposed on the lower surface of the insulating substrate;

a second electrode disposed to be spaced apart from the first electrode on the lower surface of the insulating substrate; and a radiation wire wound around the base substrate, having one end portion connected to the first electrode, and having the other end portion connected to the second electrode, wherein the insulating substrate comprises a first insulating substrate having the first electrode formed on the lower surface thereof; and a second insulating substrate having the second electrode formed on the lower surface thereof, and disposed to be spaced apart from the first insulating substrate, wherein the first insulating substrate is disposed to be biased to the first short side of the base substrate, and the second insulating substrate is disposed to be biased to the second short side of the base substrate, wherein the first insulating substrate separates the magnetic base substrate and the first electrode, and the second insulating substrate separates the magnetic base substrate and the second electrode, wherein the first electrode is disposed to be spaced at a predetermined interval apart from the base substrate by the first insulating substrate interposed between the base substrate and the first electrode, and the second electrode is disposed to be spaced at a predetermined interval apart from the base substrate by the second insulating substrate interposed between the base substrate and the second electrode, wherein the radiation wire is wound around the base substrate, and is wound in a separation space between the first insulating substrate and the second insulating substrate in the lower surface of the base substrate, wherein the insulating substrate is made of a non-magnetic material, and wherein the predetermined interval is 10 μm or more and 40 μm or less.

2. The antenna module of claim 1, wherein the base substrate is a ferrite substrate.

3. The antenna module of claim 1, wherein the insulating substrate is made of one selected from Polyimide (PI) and FR4.

4. The antenna module of claim 1, wherein the first electrode is disposed to be biased to the first short side of the insulating substrate, and the second electrode is disposed to be biased to the second short side of the insulating substrate.

5. The antenna module of claim 1, wherein the first electrode and the second electrode are a metal material.

* * * * *